US006145341A

United States Patent [19]

Leong

[11] Patent Number: 6,145,341

[45] Date of Patent: Nov. 14, 2000

[54] UNIQUELY MATING JEWELRY ITEMS MADE FROM GEMS

[76] Inventor: Henry Leong, 6 Waller Ct., Kendall Park, N.J. 08824

[21] Appl. No.: 09/301,526

[22] Filed: Apr. 28, 1999

[51] Int. Cl.[7] ..... A44C 13/00

[52] U.S. Cl. ..... 63/1.11; 63/1.16; 63/3; 63/23; 63/26; 63/28; 63/29.1; 63/32

[58] Field of Search ..... 63/1.11, 1.16, 63/3, 23, 26, 28, 29.1, 32, 33, 15.1, FOR 1.1

[56] References Cited

U.S. PATENT DOCUMENTS

| | | | |
|---|---|---|---|
| 237,989 | 2/1881 | Meyer | 63/26 |
| D. 247,881 | 5/1978 | Hitchens . | |
| 248,785 | 10/1881 | Pardee | 63/26 |
| D. 254,537 | 3/1980 | Abelson | 63/15.1 X |
| D. 254,606 | 4/1980 | Abelson | 63/15.1 X |
| D. 301,211 | 5/1989 | Kian . | |
| 1,475,734 | 11/1923 | Anthon | 63/23 X |
| 1,612,831 | 1/1927 | Peters . | |
| 1,758,447 | 5/1930 | Liebs | 63/15.1 |
| 2,016,679 | 10/1935 | Mayer | 63/3 X |
| 2,568,212 | 9/1951 | Backman | 63/DIG. 3 X |
| 2,907,187 | 10/1959 | Karp et al. | 63/32 X |
| 3,307,374 | 3/1967 | Kirshbaum | 63/1.11 |
| 3,394,692 | 7/1968 | Sirakian | 63/28 X |
| 5,682,769 | 11/1997 | Baker | 63/26 X |

FOREIGN PATENT DOCUMENTS

| | | | |
|---|---|---|---|
| 261098 | 9/1963 | Australia | 63/23 |
| 507290 | 9/1920 | France | 63/23 |
| 527461 | 10/1921 | France | 63/23 |
| 1537955 | 8/1968 | France | 63/23 |
| 2312987 | 12/1976 | France | 63/23 |
| 2355474 | 1/1978 | France | 63/23 |
| 2504813 | 11/1982 | France | 63/23 |
| 2616632 | 12/1988 | France . | |

OTHER PUBLICATIONS

"Sculptured Jewelry" by Berrocal Article from Centicore Arts International, Aug. 1980.

Catalog of Rio Grande Albuquerque, 6901 Washington N. E., Albuquerque, NM 87109–4498, p. 79, Items J, K, M and N, and p. 317, Items C and D.

*Primary Examiner*—Lynne H. Browne
*Assistant Examiner*—Andrea Chop
*Attorney, Agent, or Firm*—Richard M. Goldberg

[57] ABSTRACT

A uniquely mating jewelry item includes a first stand-alone jewelry piece including a first gem part which has been cut along a separation line from a gemstone, the first gem part having a first outer surface with one-of-kind, naturally occurring markings thereon and a first mating surface different from the first outer surface and extending along and to one side of the separation line, and a first jewelry holder secured with the first gem part for holding the first jewelry piece on a support such that the first outer surface and the first mating surface are exposed and visible; a second stand-alone jewelry piece including a second gem part which has been cut from the same gemstone, the second gem part having a second outer surface with one-of-kind, naturally occurring markings thereon and a second mating surface different from the second outer surface and extending along and to an opposite side of the separation line, and a second jewelry holder secured with the second gem part for holding the second jewelry piece on a support such that the second outer surface and the second mating surface are exposed and visible; and the second mating surface being complementary to the first mating surface for mating therewith such that the naturally-occurring markings on the first and second outer surfaces can only match with each other.

5 Claims, 8 Drawing Sheets

UNIQUELY MATING JEWELRY ITEMS MADE FROM GEMS

BACKGROUND OF THE INVENTION

This invention relates to uniquely mating jewelry pieces. As used herein the term "mating jewelry pieces" is intended to mean at least two items of jewelry intended to associate with each other in some way.

Examples of mating jewelry pieces from the prior art are shown in FIGS. 1 and 2. In FIG. 1, first heart half 10 dangles from first necklace 11 forming a first item of mating jewelry. Also in FIG. 1, second heart half 12 dangles from second necklace 14 forming a second piece of mating jewelry. FIG. 2 shows the two prior art pieces of mating jewelry mated. Mating jewelry of the type shown in FIGS. 1 and 2 is disclosed on page 79, items J, K, M, and N in a catalog of Rio Grande Albuquerque, 6901 Washington Nebr., Albuquerque, N.Mex. 87109-4490.

The problem with this prior-art mating jewelry is that it is mass produced from stamping and castings that create identical pieces. Hence if 10,000 pairs of prior-art mating hearts of FIGS. 1 and 2 are made and sold, each first heart half 10 will match all 10,000 of the second heart halves 12. The present invention overcomes this problem by producing uniquely mating jewelry wherein each piece will mate with only one other piece, no matter how many pieces of the jewelry are produced.

Also, the jewelry pieces are not stand-alone jewelry pieces. In other words, since some of the words are missing, it is clear that the jewelry pieces are associated with another jewelry piece, and this may not be aesthetically pleasing. Thus, it is visually obvious that another section is missing.

Further, to create more than two sections, it is required with this prior art to provide additional molds, which becomes more expensive. Also, to change the shape of the jewelry parts, different molds would be required.

SUMMARY OF THE INVENTION

Accordingly, it is an object of the present invention to provide a uniquely mating jewelry item that overcomes the aforementioned problems with the prior art.

It is another object of the present invention to provide a uniquely mating jewelry item in which the different jewelry pieces stand alone and form complete jewelry pieces by themselves, regardless of whether they mate with another jewelry piece, while also having an aesthetically pleasing appearance, so that it does not appear that there is a missing part.

It is another object of the present invention to provide a uniquely mating jewelry item in which each jewelry piece will mate with only one other jewelry piece, regardless of how many matching sets are mass produced.

It is still another object of the present invention to provide a uniquely mating jewelry item in which the jewelry pieces are made with gem parts cut from the same gem stone having unique, one-of-a-kind, naturally-occurring markings.

It is yet another object of the present invention to provide a uniquely mating jewelry item in which more than two gem parts can be cut from the same gemstone to provide more than two jewelry pieces.

It is a further object of the present invention to provide a uniquely mating jewelry item that is easy and economical to manufacture.

In accordance with an aspect of the present invention, a uniquely mating jewelry item is comprised of a first stand-alone jewelry piece including a first gem part which has been cut along a separation line from a gemstone, the first gem part having a first outer surface with one-of-kind, naturally occurring markings thereon and a first mating surface different from the first outer surface and extending along and to one side of the separation line, and a first jewelry holder secured with the first gem part for holding the first jewelry piece on a support such that the first outer surface and the first mating surface are exposed and visible; a second stand-alone jewelry piece including a second gem part which has been cut from the same gemstone, the second gem part having a second outer surface with one-of-kind, naturally occurring markings thereon and a second mating surface different from the second outer surface and extending along and to an opposite side of the separation line, and a second jewelry holder secured with the second gem part for holding the second jewelry piece on a support such that the second outer surface and the second mating surface are exposed and visible; and the second mating surface being complementary to the first mating surface for mating therewith such that the naturally-occurring markings on the first and second outer surfaces can only match with each other.

The first and second jewelry pieces can include pendants, brooches, tie tacks, rings, belt buckles, lockets, charms necklaces, bracelets, chokers, earrings and arm bands.

The gemstone can be selected from chalcedony, sard, hessonite, tourmaline, rubellite, school, verdelite, amethyst, prase, hawk's eye, chrysoprase, heliotrope, dendrite, scenic agate, mosquito agate, moss agate, layer onyx, jasper, jadeite, zoisite, thulite, amazonite, labradorite, turquoise, lapis, sodality, azurite, chinastolite, euclase, cassiterite, variscite, kyanite, hemmorphite, smithsonite, eilate stone, serpentine, ulexite, magnetite-jade, howlite, silver (the gem, not the metal), tufa, marble, alabaster, smoke quartz, tiger-eye, malachite, agate, opal, obsidian, quartz, Mexican agate, jade green nephrite, rose quartz, aventurine, lace agate, carnelian, ammolite, unakite, goldstone, rhodochrosite, African picture jasper, leopard jasper, crazy lace agate, Picasso jasper, sodalite, azurite malachite, copper malachite, ruby in zoisite unakite, goldshine obsidian, poppy jasper, snowflake obsidian, gemstones using dichroism and gemstones using pleochroism.

The naturally occurring markings can run parallel to the gemstone, run perpendicular to the gemstone, be random markings on the gemstone and/or be spotted markings on the gemstone.

In one embodiment, at least one gem part includes a channel therein, and each jewelry holder corresponding to the at least one gem part includes a projection for insertion into the channel.

DETAILED DESCRIPTION OF THE INVENTION

As used herein, the term "uniquely mating jewelry pieces" is intended to mean that each jewelry piece will mate with only one other jewelry piece.

The term "jewelry" is intended to mean usual items of jewelry worn or carried for personal adornment such as pendants, brooches, tie tacks, rings, belt buckles, lockets, charms, necklaces, bracelets, chokers, earrings, arm bands, etc. Unusual items of jewelry such as nose rings, belly button rings, tongue rings, other body-piercing jewelry, etc. are also included. The presently preferred from of jewelry for use with this invention is a necklace that uniquely mates with a bracelet. Of course any other mating combination, for example, bracelet to bracelet, belt buckle to ring, ring to choker, ring to ring, etc. would be in accordance with this invention.

Figure 1:
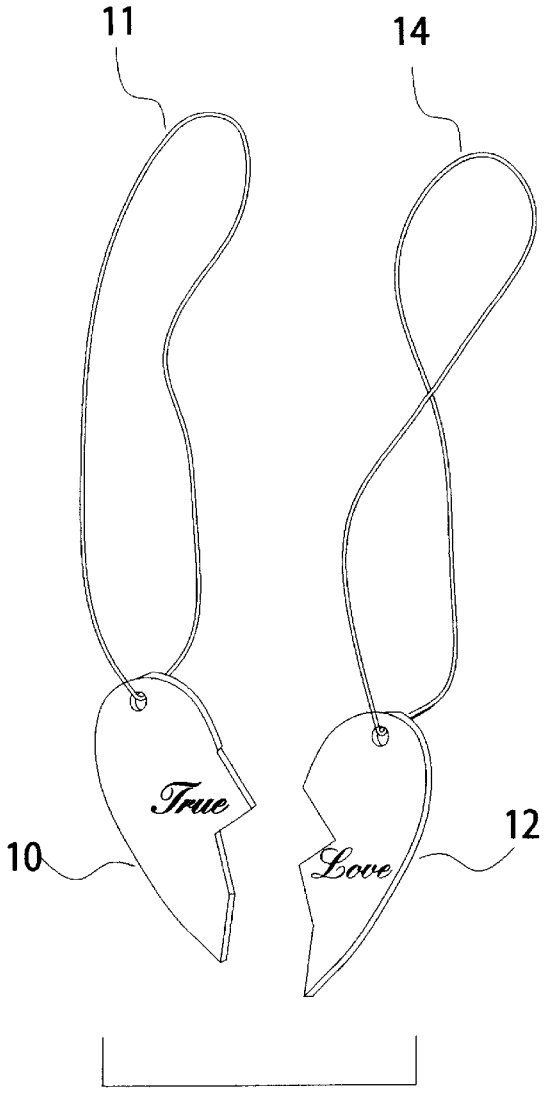
FIG 1 PRIOR ART
FIGS. 1 and 2 illustrate two pieces of prior-art mating jewelry.
Figure 2:
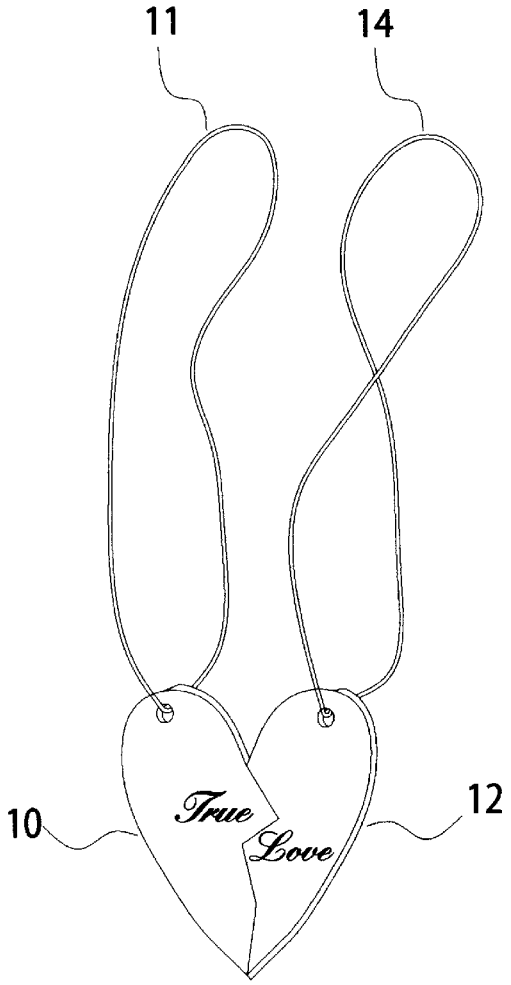
FIG 2 PRIOR ART
Figure 3:
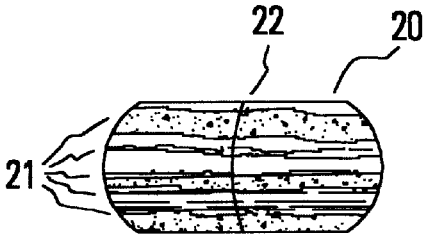
FIGS. 3 to 5 illustrate the steps taken to produce mating jewelry in accordance with the present invention.
Figure 4:
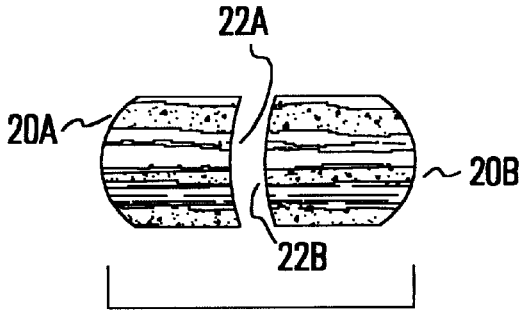
Figure 5:
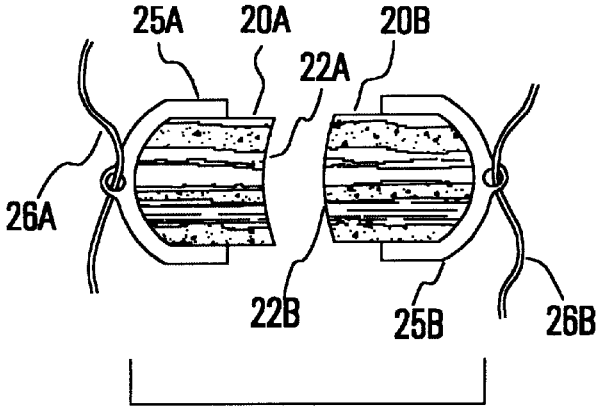

FIGS. 3 to 5 illustrate the steps taken to produce uniquely mating jewelry in accordance with this invention.

In FIG. 3 gem 20 having one-of-a-kind naturally-occurring pattern 21 is provided. The choice of gems having one-of-a-kind naturally-occurring patterns is very broad as described later. The presently preferred gems are tiger-eye and malachite having longitudinally grained naturally-occurring patterns as exemplified in FIG. 3. Other preferred gems having one-of-a-kind naturally-occurring markings are jasper, unakite, agate, and opal. As illustrated in FIG. 4, gem 20 is separated into two gem parts 20A and 20B by cutting the gem along arc 22 (FIG. 3). After the cutting, mating surfaces 22A and 22B are present on gem parts 20A and 20B respectively. Of course gem 20 could be separated into two gem parts in other ways, for example, by breaking or cutting along a cut line that is not arcuate, such as straight, jagged, jig-saw like, etc. Because no two uniquely patterned gems have the same pattern, the gem pieces so formed will be uniquely mating. Each piece will mate with only one other piece even if the arcs or other cut lines used in forming many pieces of mating jewelry are identical.

Figure 6:
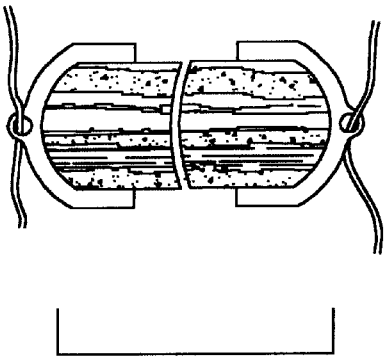
FIG. 6 illustrates two pieces of mated jewelry in accordance with this invention.

After separating gem 20 into gem parts 20A and 20B, each gem part is mounted into separate items of jewelry such that mating surfaces 22A and 22B are exposed and capable of mating when the two gem parts are juxtaposed (placed against each other) along their mating surfaces. As illustrated in FIG. 5, gem part 20A is mounted in gem holder 25A attached to necklace 26A, forming a first piece of uniquely mating jewelry. Likewise gem part 20B is mounted in holder 25B attached to bracelet 26B forming a second piece of uniquely mating jewelry. Notice how mating surfaces 22A and 22B are exposed, that is, not covered by a part of holders 25A and 25B, which would prevent mating of the jewelry pieces when they are juxtaposed as shown in FIG. 6.

Figure 7:
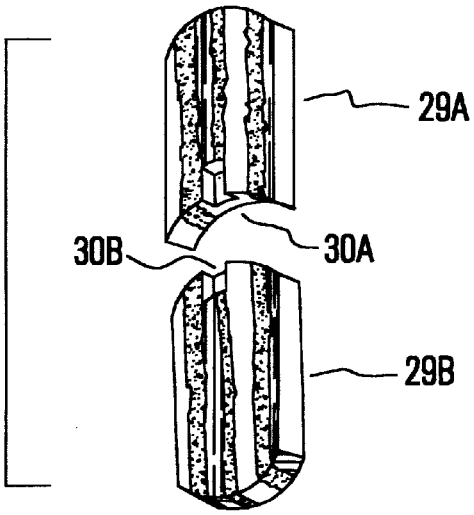
FIG. 7 is a perspective view of a preferred shape for uniquely mating gem parts in accordance with the invention.

FIG. 7 is a perspective rear view of gem parts 29A and 29B similar to those of FIG. 3. In FIG. 7 each gem part has a recess 30A and 30B respectively that is used to secure the gem part in its holder.

Figure 8:
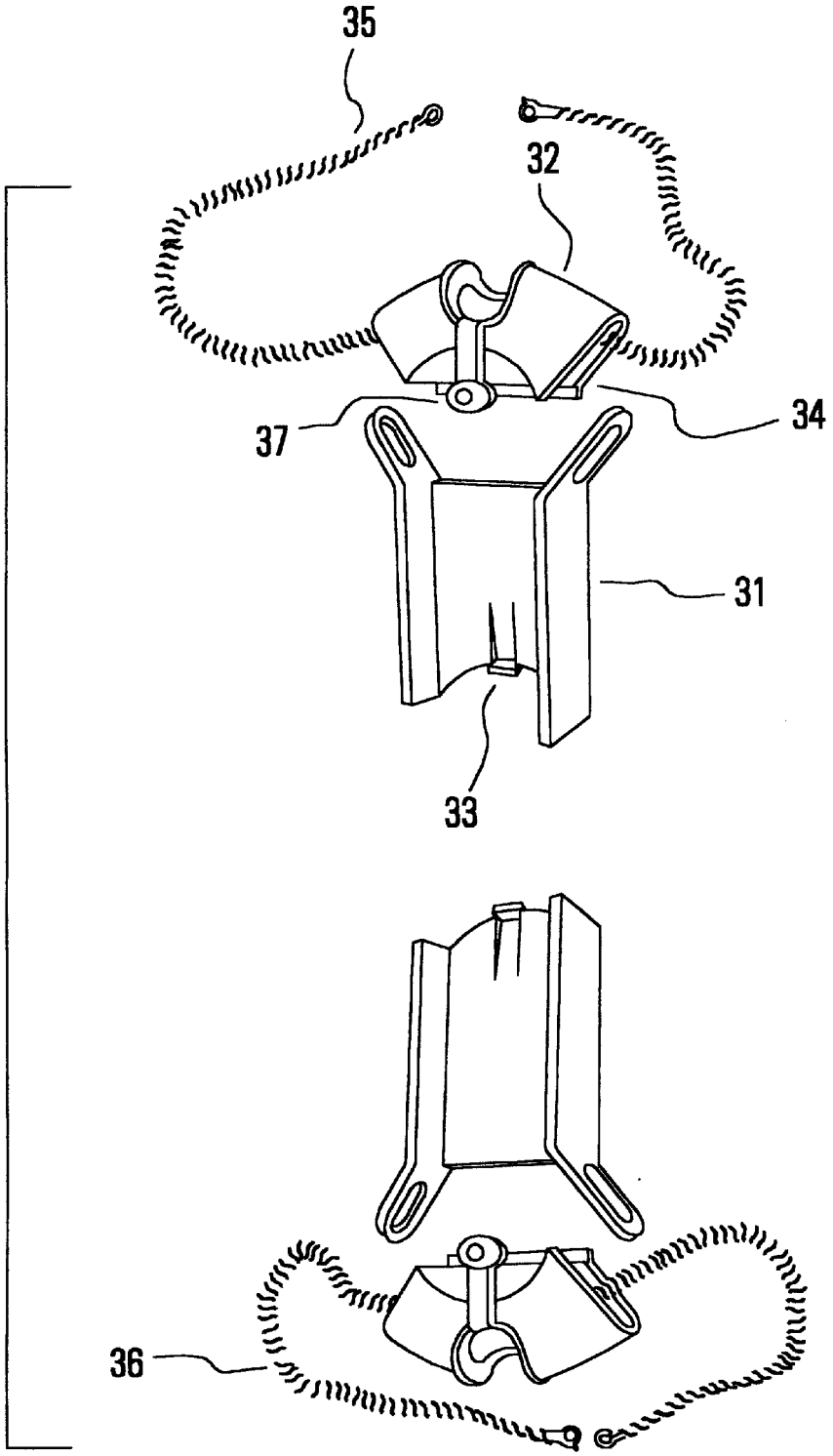
FIG. 8 is a perspective view of preferred holders for the gem parts of FIG. 7.

FIG. 8 is a perspective view of two preferred gem holders. A first holder part 31 has a "U " shaped channel for holding gem part 29A (FIG. 7) with a tab 33 adapted to fit into recess 30A. A second holder part 32 may be soldered to first part 31 to secure the gem half. An enclosed cannel 34 is provided in second holder part 32 for necklace 35. If desired a recess 37 may be provided for a gem that is more precious than the gems having one-of-a-kind naturally-occurring markings. For example, a diamond may be mounted in recess 37. The diamond would have nothing to do with the uniquely mating aspects of this invention.

The gem part 29B (FIG. 7) is held by the holder parts shown in the lower part of FIG. 8, which are nearly identical to the parts at the top of FIG. 8 described previously. A bracelet 36 may be used instead of necklace 35. Of course both mating jewelry pieces could be necklaces, bracelets or any other combination of conventional or non-conventional jewelry as defined previously.

Figure 9:
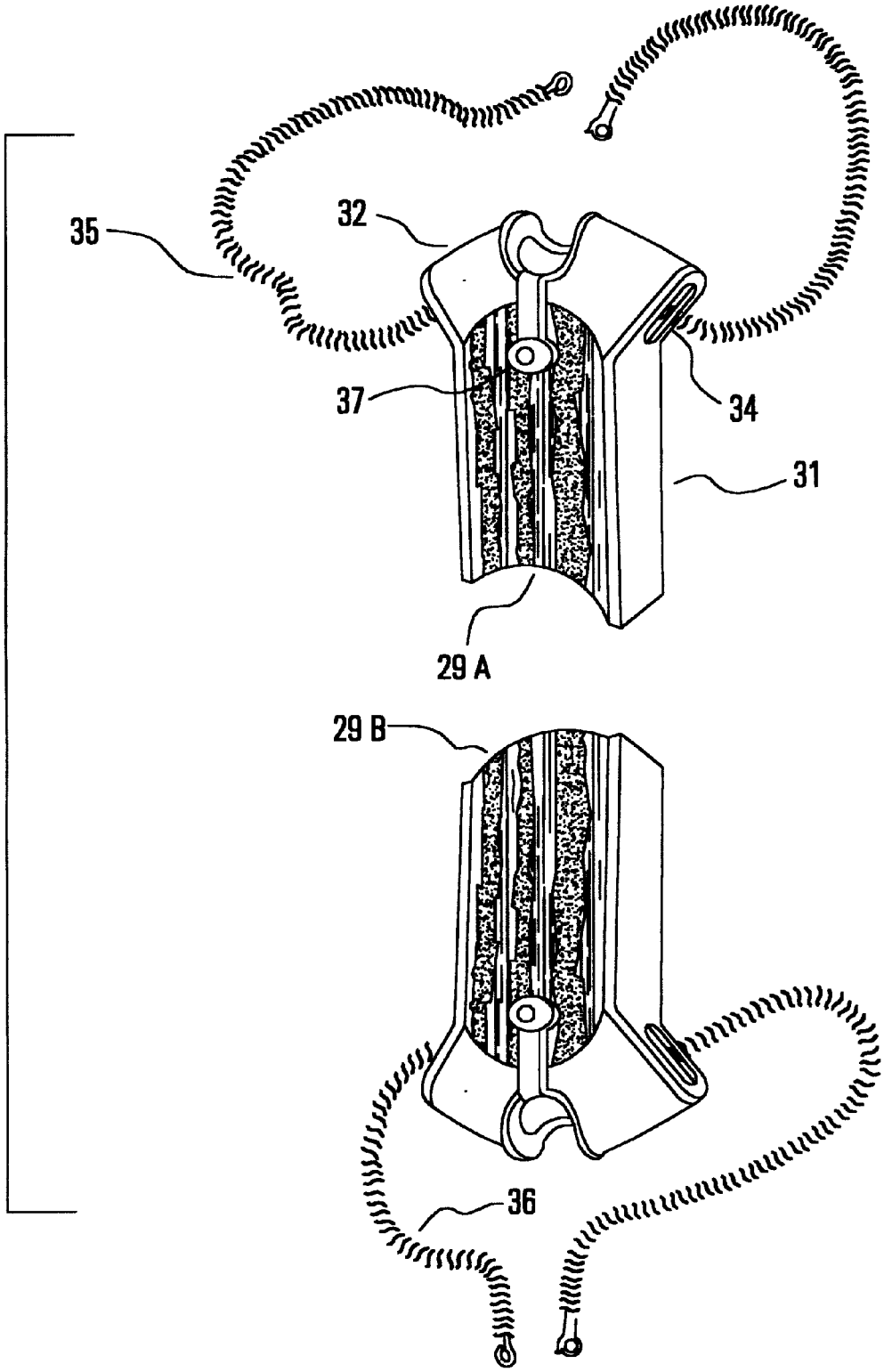
FIG. 9 is a perspective view of two uniquely mating jewelry pieces formed when the parts of FIGS. 7 and 8 are assembled.

FIG. 9 is a perspective view of the parts of FIGS. 7 and 8 assembled to form two pieces of uniquely mating jewelry in accordance with the invention.

Figure 10:
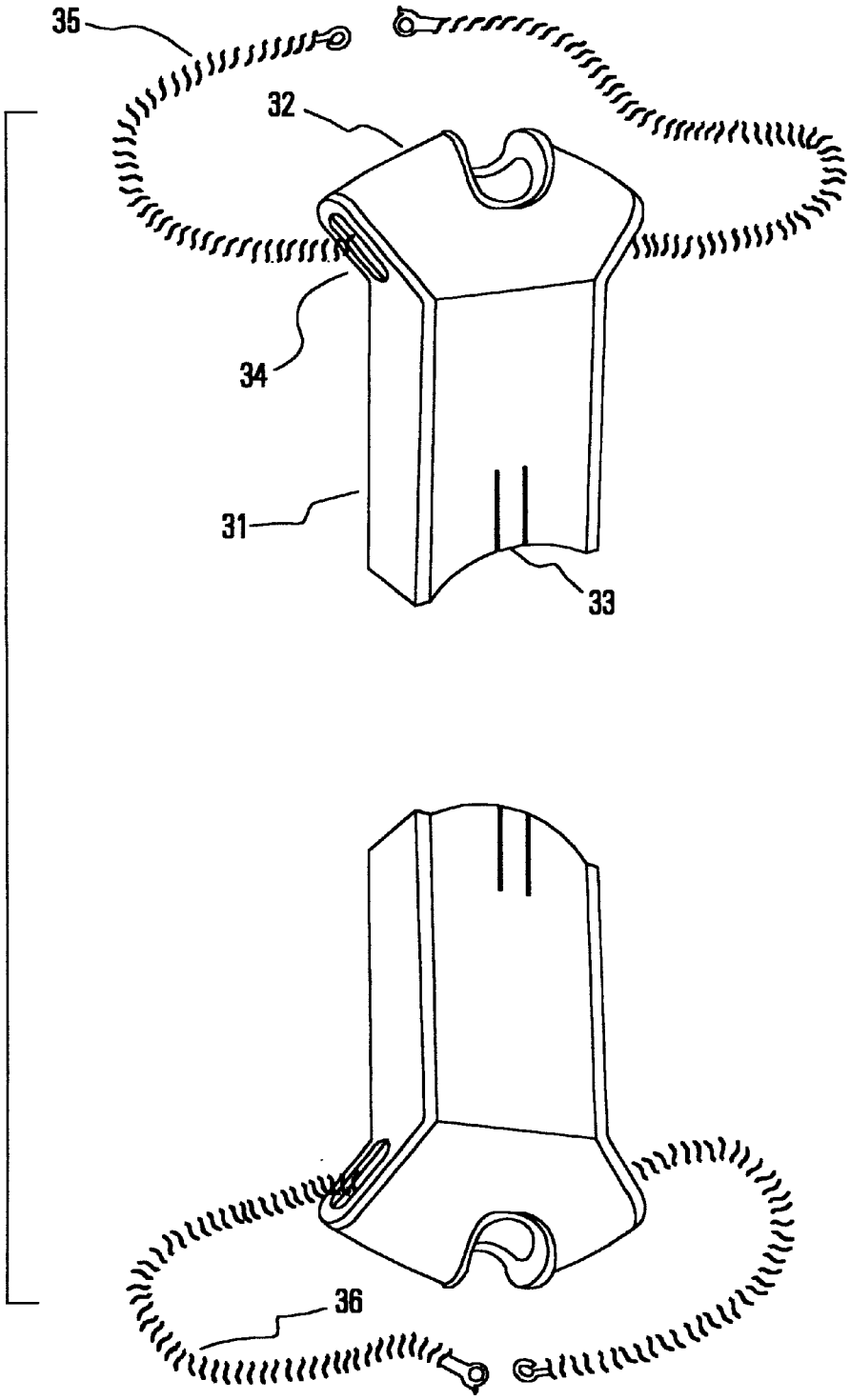
FIG. 10 is a perspective view of the rear side of the assembled jewelry pieces of FIG. 9.

FIG. 10 is a perspective view of the rear side of the assembled pieces of FIG. 9.

Figure 11:
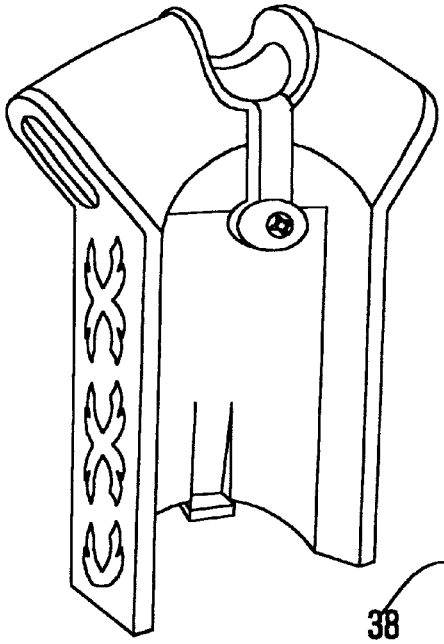
FIG. 11 is a perspective view of a more preferred gem holder, similar to that of FIG. 8.
Figure 12:
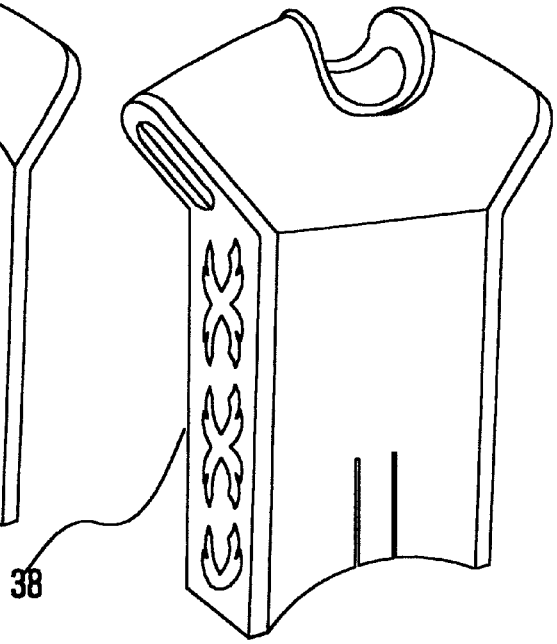
FIG. 12 is a perspective view of the rear side of the gem holder of FIG. 11.

FIGS. 11 and 12 are front and rear perspective views respectively of the presently most preferred gem holder for use with this invention. The holder of FIGS. 11 and 12 is the same as the top holder of FIGS. 9 and 10 except for the engraving 38, not present on the holders illustrated in FIGS. 9 and 10.

Figure 13:
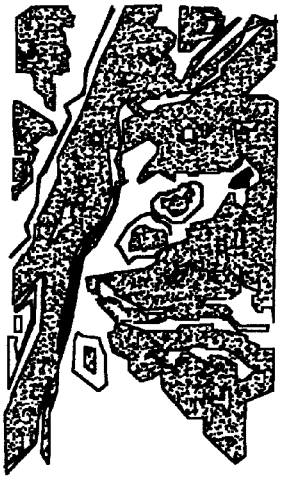
FIGS. 13 to 15 illustrate some of the gems having one of a kind markings that may be used with this invention.
Figure 14:
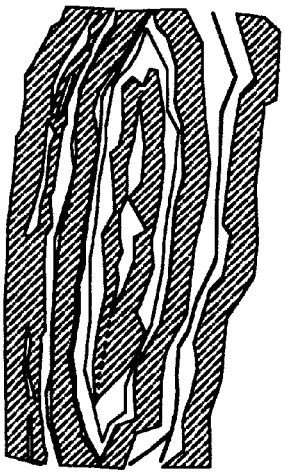
Figure 15:
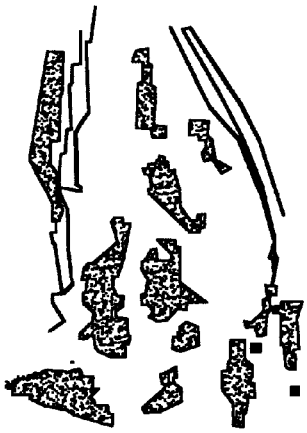

The variety of gems having one-of-a-kind naturally-occurring markings that may be used to practice the present invention is nearly endless. The one-of-a-kind naturally-occurring pattern may be speckled as shown in FIG. 13. Some jasper, especially leopard-skin jasper, and unakite gems have unique speckled patterns. The naturally-occurring pattern may be a swirl of many colors as found in some agate gems, as shown in FIG. 14. Some opal gems have a unique grating which appears when the gem is held at a correct angle to a beam of light. The grating, which is unique to each opal, is illustrated in FIG. 15. Thus, the grain or vein patterns can run parallel or perpendicular, or be random or spotted.

Following is a partial list of gems having one-of-a-kind naturally-occurring markings that may be used to make uniquely mating jewelry in accordance with this invention: chalcedony, sard, hessonite, tourmaline, rubellite, school, verdelite, amethyst, prase, hawk's eye, chrysoprase, heliotrope, dendrite, scenic agate, mosquito agate, moss agate, layer onyx, jasper, jadeite, zoisite, thulite, amazonite, labradorite, turquoise, lapis, sodality, azurite, chinastolite, euclase, cassiterite, variscite, kyanite, hemmorphite, smithsonite, eilate stone, serpentine, ulexite, magnetite-jade, howlite, silver (the gem, not the metal), tufa, marble, alabaster, smoke quartz, tiger-eye, malachite, agate, opal, obsidian, quartz, Mexican agate, jade green nephrite, rose quartz, aventurine, lace agate, carnelian, ammolite, unakite, goldstone, rhodochrosite, African picture jasper, leopard jasper, crazy lace agate, Picasso jasper, sodalite, azurite malachite, copper malachite, ruby in zoisite unakite, gold-shine obsidian, poppy jasper and snowflake obsidian. Many of these and other gems having one-of-a-kind naturally-occurring markings are listed in *Gemstones of the World* by Walter Schumann, published by Sterling. If an individual gem from the above group happens to lack a one-of-a-kind naturally-occurring marking, for example, by being of a solid color, then that particular gem would not be used to produce jewelry in accordance with the present invention.

Gemstones using dichroism (differences in refraction of light) and pleochroism (differences in absorption of light) can also be used.

Even some items not normally thought of as "gems" may be used as gems having one-of-a-kind naturally-occurring markings in accordance with the invention. For example, amber, mother of pearl and coral may be used as long as the pieces selected have one-of-a-kind naturally-occurring markings.

Hence the term "gem having a one-of-a-kind naturally-occurring marking" includes all those mentioned above and their many, many equivalents which are far too numerous to mention here.

FIGS. 16 to 25 illustrate some of the various items of jewelry that may be produced in accordance with the invention. The matching gem parts all have reference numeral 40, and their exposed mating surfaces have reference numeral 39. Of course very simple pieces of jewelry, very ornate pieces and everything between may be produced in accordance with the present invention.

Figure 16:
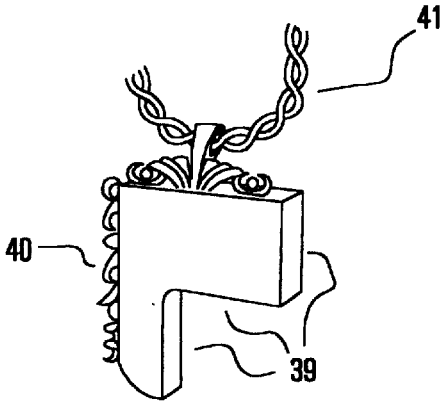
FIGS. 16 to 25 illustrate some of the various items of jewelry that may be produced in accordance with the invention.
Figure 17:
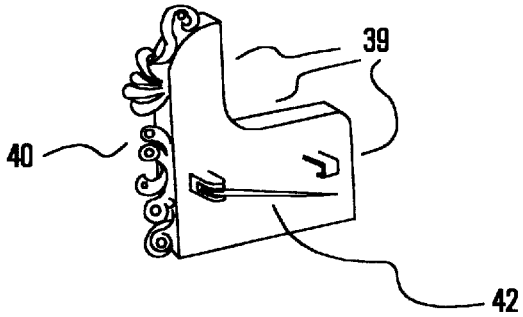

In FIG. 16, the mating jewelry piece is a pendant dangling from necklace 41. In FIG. 17, the gem part is attached to pin 42 forming a brooch. The jewelry pieces of FIGS. 16 and 17 form uniquely mating jewelry in accordance with this invention.

Figure 18:
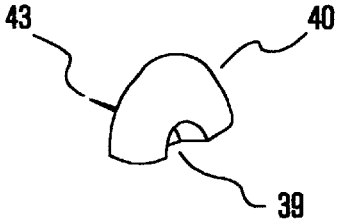
Figure 19:
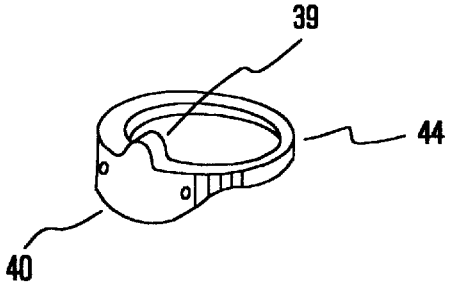

In FIG. 18, the gem part is attached to pin 43 to form a tie tack. In FIG. 19 the gem part is attached to finger ring 44. The jewelry pieces of FIGS. 18 and 19 form uniquely mating jewelry in accordance with this invention.

Figure 20:
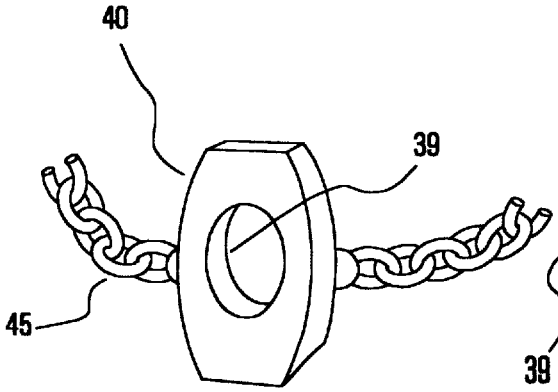
Figure 21:
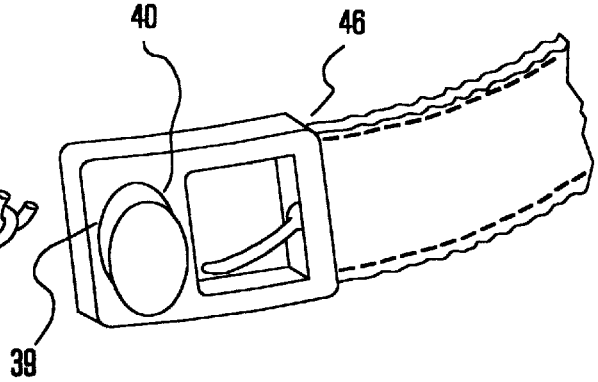

In FIG. 20, the gem part is attached to bracelet 45. In FIG. 21, the gem part is attached to belt buckle 46. The jewelry pieces of FIGS. 20 and 21 form uniquely mating jewelry in accordance with this invention.

Figure 22:
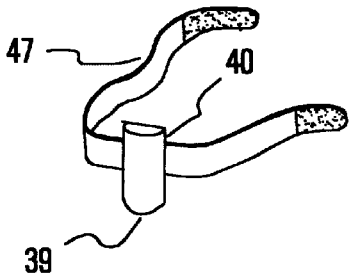
Figure 23:
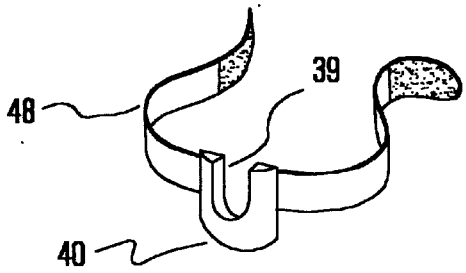

In FIG. 22, the gem part is attached to arm band 47. In FIG. 23, the gem part is attached to choker 48. The jewelry pieces of FIGS. 22 and 23 form uniquely mating jewelry in accordance with this invention.

Figure 24:
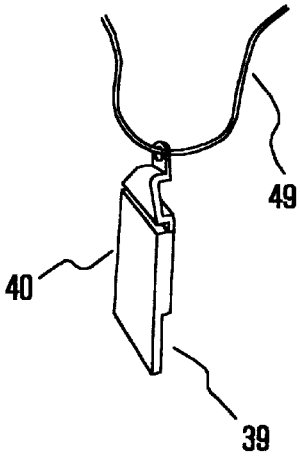
Figure 25:
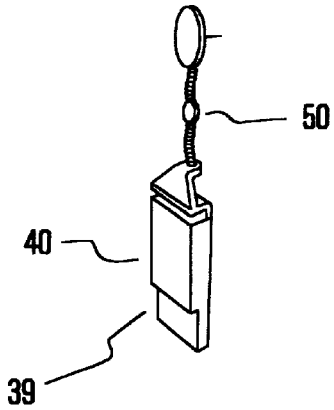

In FIG. 24, the gem part dangles as a charm from bracelet 49. In FIG. 25, gem part is attached to earring 50. The jewelry pieces of FIGS. 24 and 25 form uniquely mating jewelry in accordance with this invention.

Figure 26:
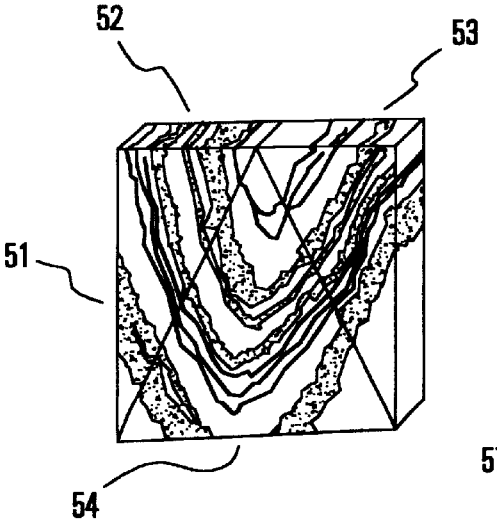
FIGS. 26 and 27 illustrate an alternative way to cut a gem having a one-of-a-kind naturally-occurring marking for forming jewelry in accordance with this invention.
Figure 27:
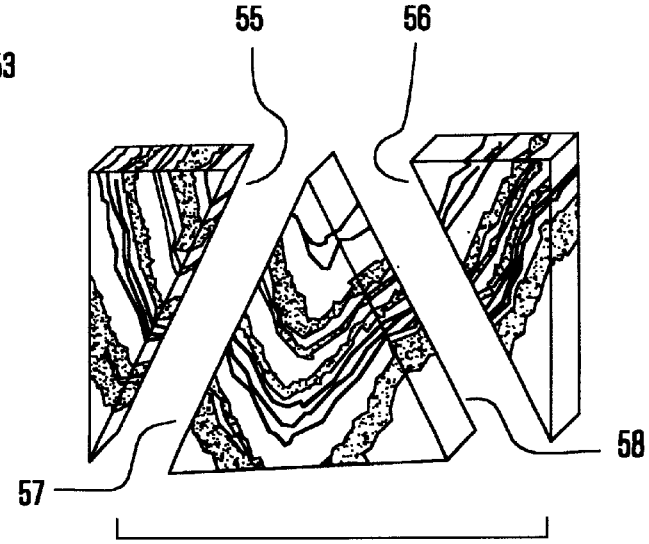

FIGS. 26 and 27 illustrate an alternative way to cut a gem having a one-of-a-kind naturally-occurring marking. Gem 51 is cut into three gem parts 52, 53 and 54 having mating surfaces 55, 56, 57, and 58. Gem parts 52 and 53 could be mounted in a single piece of jewelry of mating with a piece of jewelry into which gem part 54 has been mounted. Alternatively gem parts 52 and 53 could be mounted into two separate pieces of jewelry, each of which would mate a piece of jewelry containing gem part 54. Hence this invention covers more than two pieces of uniquely mating jewelry constructed in accordance therewith.

Of course the examples and drawings only illustrate preferred aspects of the invention, which is limited only the appended claims.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A uniquely mating jewelry item comprising:

a first stand-alone jewelry piece including:

a first opaque gem part which has been cut along a separation line from a gemstone, said first gem part having:

a first outer surface with one of a kind, naturally occurring markings thereon, and a first mating surface different from said first outer surface and extending along and to one side of said separation line, and a first jewelry holder secured with said first gem part for holding said first jewelry piece on a support such that said first outer surface and said first mating surface are exposed and visible;

a second stand-alone jewelry piece including:

a second opaque gem part which has been cut from said gemstone, said second gem part having:

a second outer surface with one of a kind, naturally occurring markings thereon, and a second mating surface different from said second outer surface and extending along and to an opposite side of said separation line, said second mating surface being in an identical complementary shape and dimensions to said first mating surface so as to recreate said gemstone only when said second mating surface is placed in an end to end abutting relation with said first mating surface, and a second jewelry holder secured with said second gem part for holding said second jewelry piece on a support such that said second outer surface and said second mating surface are exposed and visible; and said naturally occurring markings on said first outer surface of said first opaque gem part are capable of matching with said naturally occurring markings on said second outer surface of only said second opaque gem part and only when said first and second mating surfaces are in said end to end abutting relation so as to provide only one possible combination of said matching.

2. A uniquely mating jewelry item according to claim 1, wherein at least one of said first and second jewelry pieces includes a jewelry piece selected from the group consisting of pendants, brooches, tie tacks, rings, belt buckles, lockets, charms necklaces, bracelets, chokers, earrings and arm bands.

3. A uniquely mating jewelry item according to claim 1, wherein said gemstone is selected from the group consisting of chalcedony, sard, hessonite, tourmaline, rubellite, school, verdelite, amethyst, prase, hawk's eye, chrysoprase, heliotrope, dendrite, scenic agate, mosquito agate, moss agate, layer onyx, jasper, jadeite, zoisite, thulite, amazonite, labradorite, turquoise, lapis, sodality, azurite, chinastolite, euclase, cassiterite, variscite, kyanite, hemmorphite, smithsonite, eilate stone, serpentine, ulexite, magnetite-jade, howlite, silver gem, tufa, marble, alabaster, smoke quartz, tiger-eye, malachite, agate, opal, obsidian, quartz, Mexican agate, jade green nephrite, rose quartz, aventurine, lace agate, carnelian, ammolite, unakite, goldstone, rhodochrosite, African picture jasper, leopard jasper, crazy lace agate, Picasso jasper, sodalite, azurite malachite, copper malachite, ruby in zoisite unakite, goldshine obsidian, poppy jasper, snowflake obsidian, gemstones using dichroism and gemstones using pleochroism.

4. A uniquely mating jewelry item according to claim 1, wherein said naturally occurring markings include markings selected from the group consisting of markings that run parallel to the gemstone, markings that run perpendicular to the gemstone, random markings on the gemstone and spotted markings on the gemstone.

5. A uniquely mating jewelry item according to claim 1, wherein at least one gem part includes a channel therein, and said jewelry holder corresponding to said at least one gem part includes a projection for insertion into said channel.

* * * * *